US006416798B1

(12) United States Patent
Gentine et al.

(10) Patent No.: US 6,416,798 B1
(45) Date of Patent: Jul. 9, 2002

(54) PACKAGING HAVING PROTECTED INFORMATION AND METHOD

(75) Inventors: Larry J. Gentine, Plymouth; Matthew J. Wusterbarth, Kiel; Barry M. Blatz, Kiel; Thomas J. Spaeth, Kiel, all of WI (US)

(73) Assignee: Sargento Foods Inc., Plymouth, WI (US)

( * ) Notice: Subject to any disclaimer, the term of this patent is extended or adjusted under 35 U.S.C. 154(b) by 0 days.

(21) Appl. No.: 09/521,007

(22) Filed: Mar. 7, 2000

(51) Int. Cl.[7] ..... B65D 85/00

(52) U.S. Cl. ..... 426/87; 426/106; 426/130; 426/383; 426/410; 53/131.5; 53/411; 283/91; 283/92; 383/107

(58) Field of Search ..... 283/91, 92, 74; 426/87, 383, 106, 130, 410; 53/411, 451, 551, 131.4, 131.5; 383/107

(56) References Cited

U.S. PATENT DOCUMENTS

| | | | | |
|---|---|---|---|---|
| 3,625,270 | A | | 12/1971 | Skendzic |
| 3,827,472 | A | | 8/1974 | Uramoto |
| 4,006,753 | A | * | 2/1977 | Ingram, Jr. et al. |
| 4,098,577 | A | | 7/1978 | Halpern |
| 4,265,074 | A | * | 5/1981 | Reuter et al. ..... 53/551 |
| 4,288,965 | A | | 9/1981 | James |
| 4,505,399 | A | | 3/1985 | Weiner |
| 4,526,752 | A | | 7/1985 | Perlman et al. |
| 4,532,753 | A | | 8/1985 | Kovacs |
| 4,557,505 | A | | 12/1985 | Schaefer et al. |
| 4,589,145 | A | | 5/1986 | Van Erden et al. |
| 4,709,396 | A | | 11/1987 | Voshall et al. |
| 4,709,397 | A | | 11/1987 | Voshall et al. |
| 4,718,553 | A | | 1/1988 | Adamoli et al. |
| 4,749,084 | A | | 6/1988 | Pereyra |
| 4,834,552 | A | | 5/1989 | Makowka |
| 4,876,123 | A | | 10/1989 | Rivera et al. |
| 4,884,387 | A | | 12/1989 | James |
| 4,931,327 | A | | 6/1990 | Liu et al. |
| 4,966,470 | A | | 10/1990 | Thompson et al. |
| 4,972,953 | A | | 11/1990 | Friedman et al. |
| 5,064,664 | A | | 11/1991 | Hustad et al. |
| 5,103,979 | A | | 4/1992 | Hustad |
| 5,255,497 | A | | 10/1993 | Zoromski et al. |
| 5,377,474 | A | | 1/1995 | Kovacs et al. |
| 5,485,712 | A | | 1/1996 | Cherney et al. |
| 5,701,724 | A | * | 12/1997 | Meli et al. ..... 53/451 |
| 5,715,656 | A | | 2/1998 | Pearce |
| 5,727,686 | A | * | 3/1998 | Kristal ..... 206/459.1 |
| 5,852,920 | A | | 12/1998 | Linkiewicz |
| 5,895,073 | A | * | 4/1999 | Moore ..... 283/70 |

OTHER PUBLICATIONS

The Wiley Encyclopedia of packaging technology, John Wiley & Son, 1986, pp. 364, 365, 367–369.*

Hayssen ECON–O–MATIC RT'S Publication No. GBRT 55, USA.

* cited by examiner

*Primary Examiner*—Milton I. Cano
*Assistant Examiner*—Hao Mai
(74) *Attorney, Agent, or Firm*—Ryan Krumholz & Manion, S.C.

(57) ABSTRACT

A package and a process is provided for packaging a perishable product and providing a tamperproof visible date code on the resultant package. The process includes the steps of providing form, fill and seal package making process equipment; and providing to that equipment a supply of plastic film in strip form having opposed first and second lateral edges and a thermally sealable side. A date code is printed adjacent to the first edge on the sealable side. The film is then conveyed through a folding device to cause the printed date code to be overlaid by the opposite or second lateral edge of the plastic film. The lateral edges of the film are then thermally sealed together with the second edge overlying the imprinted area thereby forming a tube. The tube is then formed into a series of individual packages which are filled with the perishable product.

8 Claims, 6 Drawing Sheets

PACKAGING HAVING PROTECTED INFORMATION AND METHOD

This invention relates to packaging for foods or other perishable commodities, and more specifically to such packaging provided with printed information such as date codes which is protected against damage from water, abrasion or tampering. The invention also provides packages bearing protected inscriptions relating to specific packages and their contents.

BACKGROUND OF THE INVENTION

The use of date codes on food products and other perishable items has become commonplace. Generally such date. codes are printed on the product. Unfortunately, occurrences have been noted of tampering or alteration of date codes by unscrupulous individuals. Problems may also arise due to abrasion against the package during handling or transportation which may obscure the printing. More importantly, in the case of food packaging, it is important, also, to avoid contact between the ink and the packaged foods. Thus, there has been a need for processes to apply printing in more permanent fashion or, otherwise, to render the printed information tamperproof.

Additionally, printing may be applied to packaging for providing bar codes, for example, to provide pricing information. Also, printing may be applied using ink invisible under ambient lighting but which is visible using light of a special frequency.

Yet another situation in which problems are encountered is in the case of packaging together of multiple food ingredients, for example, prepackaged salads where individual packets of meat or cheese may be included in an overall package which contains moist produce such as lettuce. In this case, moisture on the produce may wipe away or distort any printing on the outside of the packets. It is, of course necessary that any such printing be done with food grade, inks. Such inks, however, are not permanent, However, heretofore, satisfactory methods for preventing the distortion and other aforementioned problems have been lacking.

SUMMARY OF THE INVENTION

The present invention provides an improved process for applying and securing imprints such as date codes to packages for containing perishable products in a manner that renders them virtually tamperproof and avoids the other above-enumerated problems encountered in the prior art. In accordance with an important aspect of the invention, such imprints are applied between sealed layers of a package. In accordance with a related aspect, the date codes or other imprints are covered by a layer of transparent packaging material so that the date codes remain visible but are tamperproof and moisture and abrasion resistant. Such imprints may contain information about the source of the goods. For example, identification of a packaging plant or specific production line or batch, may be imprinted on each package.

In accordance with a further related aspect, the packages are formed, in accordance with the invention, utilizing readily available packaging equipment. In an important embodiment of the invention, the equipment is of the form, fill and seal type. The process of this invention is especially. adapted to the use of vertical form, fill and seal packaging equipment used for packaging perishable foods such as cheese, meats, etc.

Any commercially available packaging equipment, such as form, fill and seal equipment may be used in the practice of the invention. Examples form, fill and seal equipment are those described in great detail, for example, in U.S. Pat. Nos. 4,288,965, 4,532,753, 4,884,387, 5,255,497,. 5,377,474, 5,485,712, 5,715,656, 5,752,370 and 5,852,920, which disclosures are incorporated by reference herein.

Briefly, the invention provides a process for packaging perishable products while providing tamperproof, water and abrasion resistant visible imprints such as date codes on the resultant packages. A preferred process of the invention includes the steps of providing form, fill and seal package making process equipment; and providing to that equipment a supply of plastic film in strip form having opposed first and second lateral edges and a thermally sealable side. An imprint is applied adjacent to a first edge on the sealable side. The film is then conveyed through a folding device to cause the printed date code to be overlaid. by the opposite or second lateral edge of the plastic film. The lateral edges of the film are then thermally sealed together with the second edge overlying the imprinted area adjacent to the first edge, thereby forming a thin walled plastic tube. The tube is then formed into a series of individual packages which are filled with the perishable product and sealed. The protected date code or other imprint is then visible through the transparent, sealed packaging material either under ambient light conditions or by the use of light of a special frequency.

In one embodiment, the tube is formed with a fin type seal. In this manner the opposite edges of the sealable side are thermally sealed together. However, an overlapping type seal may be formed instead, if desired. Sealing of the tube into individual packages and severing the packages from the tube results in packages containing a perishable product, such as comminuted cheese, within a plastic film package having fin type seals on three sides, with a tamperproof date code contained between the sealed-together layers of one of the seals. In other cases such seals may be formed on all four sides of the packages.

In accordance with a further aspect of the invention, there is provided a sealed package enclosing specific product wherein the package is imprinted with information relating to that specific product with the imprint being protected in accordance with the invention.

A polymeric plastic layer having a transparent portion forms at least one exterior surface of the container, the transparent portion being bonded at an interface to a substrate of the package. The substrate may be a portion of the same polymeric film or a separate element, for example, a plastic cup which also forms a part of the final sealed container. An inscription formed in the interface is protected by and viewable through the transparent portion, the inscription providing information relating specifically to the individual sealed package and the specific product contents enclosed therein.

Further aspects and objects of the invention will be apparent from the appended claims, the following detailed description and the drawings.

DETAILED DESCRIPTION OF THE INVENTION

Figure 1:
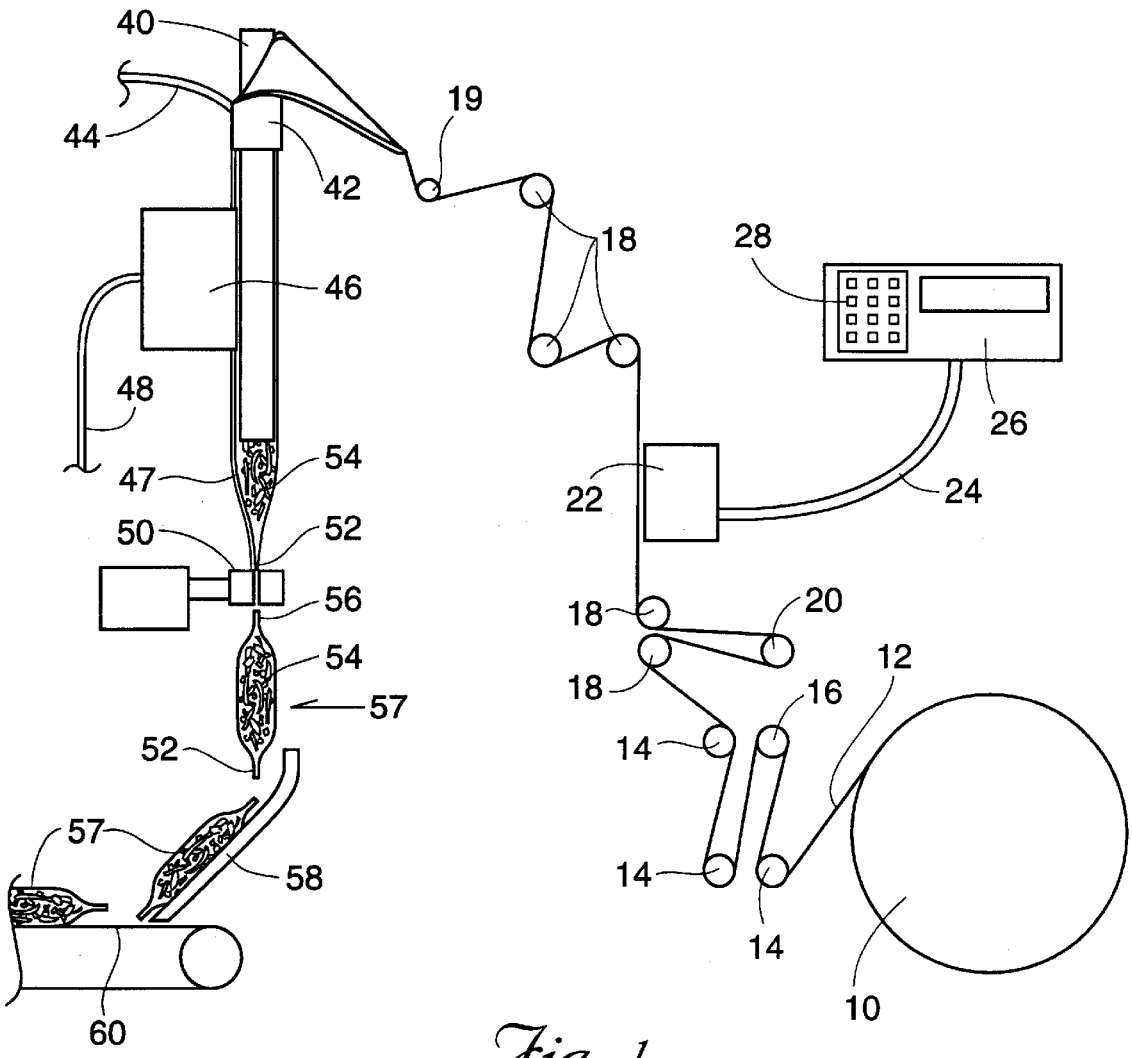
FIG. 1 is a side view, in somewhat diagrammatic form, of a vertical form, fill and seal packaging system incorporating invention.

Referring more particularly to the drawings, in FIG. 1 there is shown an overall schematic view of a process. and apparatus used in the practice of this invention. A roll 10 of film 12 is provided for formation of packages. Film 12 is of a well-known type which has a thermoplastic sealable side and an opposite side which is, relatively, more heat resistant. Such composite film materials are commercially available and the specific composition thereof does not form a part .of this invention.

As the film 12 is unwound from roll 10 it is transported over a series of rollers 14 and 16. These rollers generally would be arranged so that an accumulator section is present in order to accommodate variations in the speed of the package-forming section, which variations inevitably occur. Another series of rollers 18 and 20 are also shown, which also may serve a registration function.

The film 12 then travels in front of an ink jet printer 22. Printer 22 is adapted to apply ink to the sealable surface of film 12 in the form of a date code. The film 12 does not actually contact printer 22 but rather travels in close proximity thereto with small droplets of ink being ejected by the printer so that they impinge on the surface of film 12. It will apparent to those skilled in the art that other printing devices may be substituted, for example, contact type printers.

A conduit 24, such as metal tubing or an elastomeric hose, is provided to supply ink to the printer 22. Conduit 24 also contains wiring to electrically connect the printer 22 to a controller 26. Controller 26 includes a microprocessor and is actuated by one or more keyboards 28 which enable the control of printer 22 in order to cause printing of selected letters and numerals as required.

Figure 2:
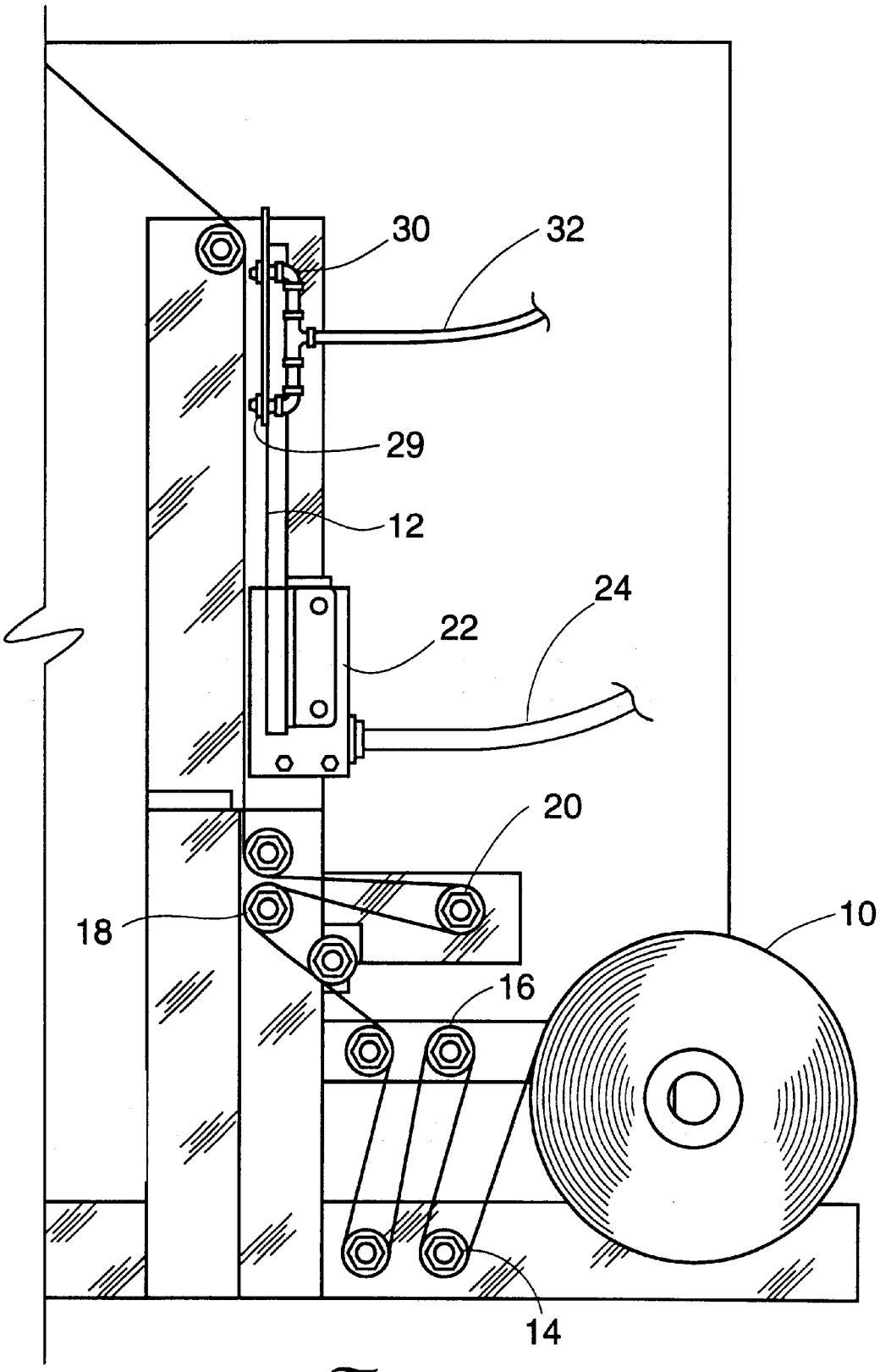
FIG. 2 is an enlarged and more detailed view of an unwinding and printing section of the system shown in FIG. 1 with some parts shown in schematic and/or fragmentary form.

As seen in FIG. 2, air discharge nozzles 29 and 30 are provided to blow a stream of gas on the freshly printed area of the film 12 to accelerate the drying of the ink printed thereon. A hose 32 is provided for connecting the nozzles 29 and 30 to a supply of compressed gas.

Figure 3:
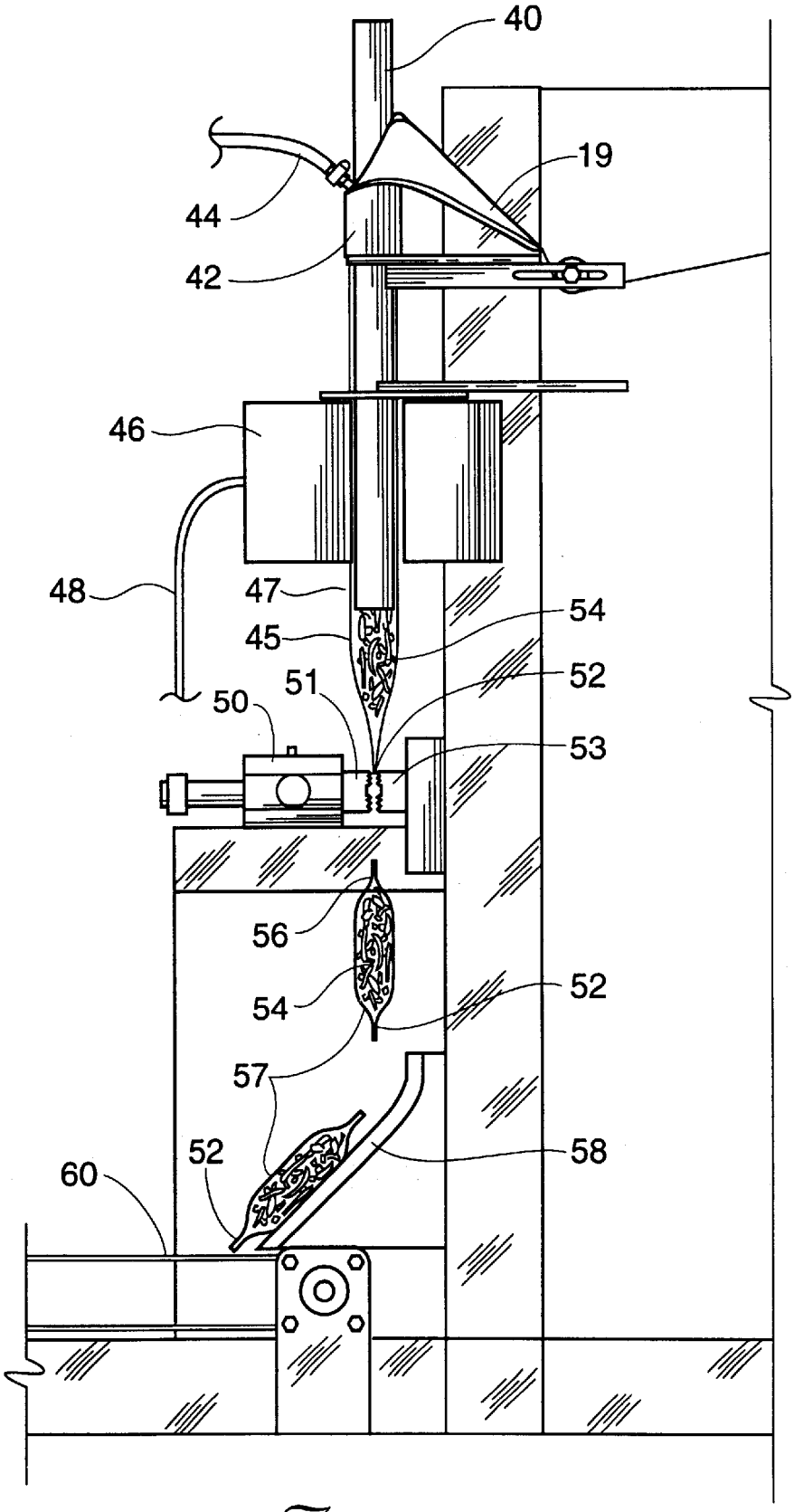
FIG. 3 is a side elevational view showing the package forming, filling and sealing sections of the system of FIG. 1 with components shown somewhat diagrammatically and with some parts in fragmentary form.

Film 12, first passing over an adjustable roller 19, is then guided by means of a forming shoulder 42 so as to encircle a forming tube 40. As also seen in FIGS. 1 and 3 the tubular film is sealed by means of a seam sealer 46, which produces an integral plastic tube 47. Seam sealer 46 may be utilized, as desired, to form either a fin type seal 45 or, alternatively, an overlapping type seal, if desired. Gases may be introduced through conduit 44 if desired.

In most instances, in the case of food packaging, a fin type seal is preferred. In this case the printed edge of the film 12 on which the date code 23 is printed is placed in face-to-face contact with the opposite edge of the film with the opposite edge overlying the printing and the two edges thermally sealed together by means of heat sealer 46. Sealer 46 is connected by suitable conventional wiring 48 to a source of electrical power.

Figure 4:
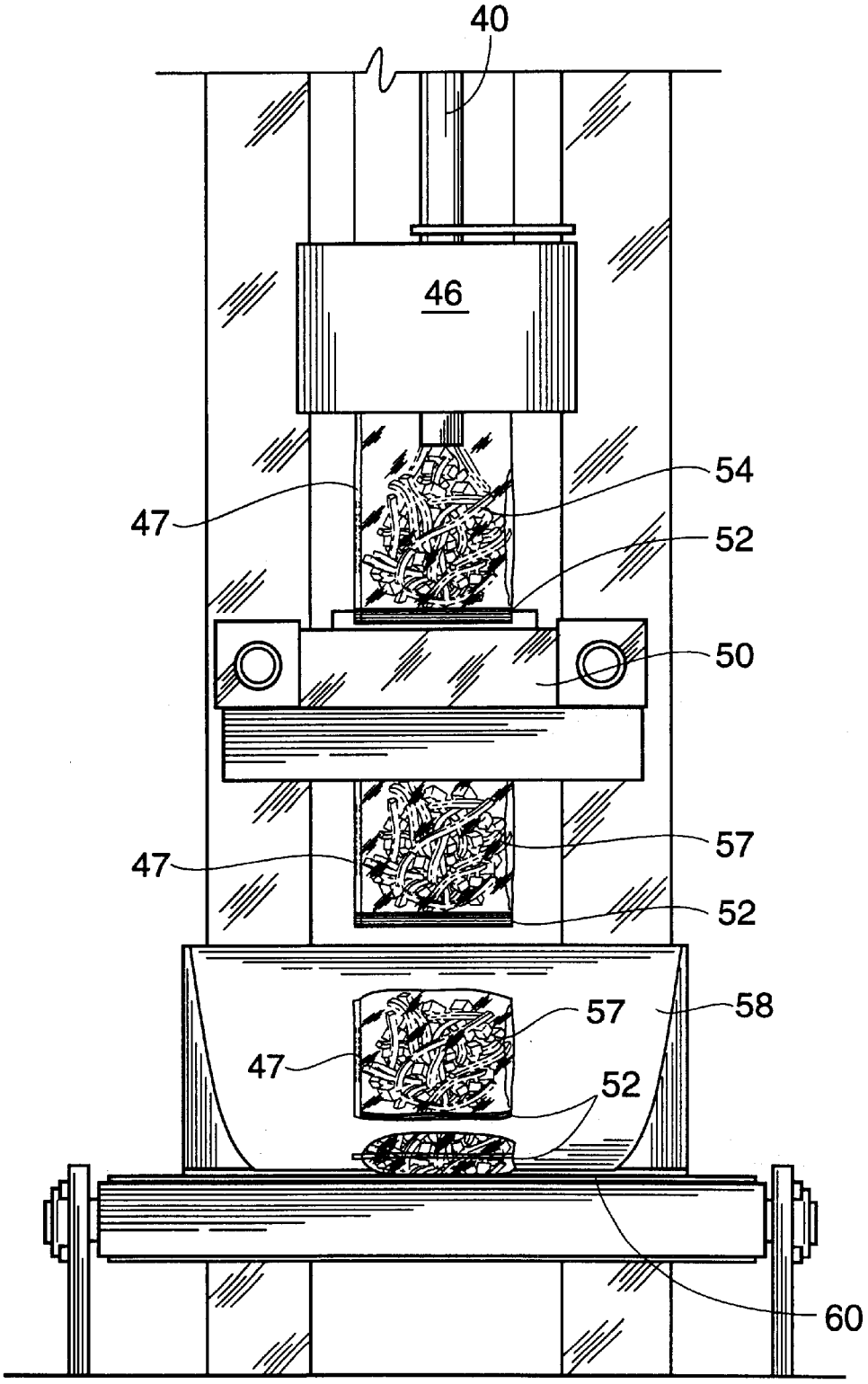
FIG. 4 is front elevational view of the apparatus shown in FIG. 3.

In the case of such a fin type seal 45 it will be readily apparent that the sealable thermoplastic surfaces are in contact with each other. Then, as the tube moves downwardly as best seen in FIGS. 3 and 4, a sealer/cutter 50, provided with movable jaws 51 and 53, is utilized to form a bottom seal 52 on the tube 47, which is then filled through tube 40 with a measured amount of product 54. Product 54 is shown to be shredded cheese 55 for purposes of illustration, but may be any perishable product to which application of a date code would be desirable. In the diagrammatic view of FIG. 1, the components are all shown from the side for purposes of illustration, but it should be understood that, in actual practice, the sealer 50 and all components downstream therefrom would usually be oriented at right angles from the illustrated orientation.

Sealer/cutter 50 simultaneously forms a top seal 56 of a preceding package 57, which is simultaneously severed from the bottom of the tube 47. Also, as seen, the product 54 is thereby sealed into an enclosed plastic pouch 57. As an alternative, the printing can be applied in a direction perpendicular to the direction of motion of the packages 57. In that event, the printing can be sealed within either the bottom seal 52 or top seal 56 of each succeeding package.

Figure 5:
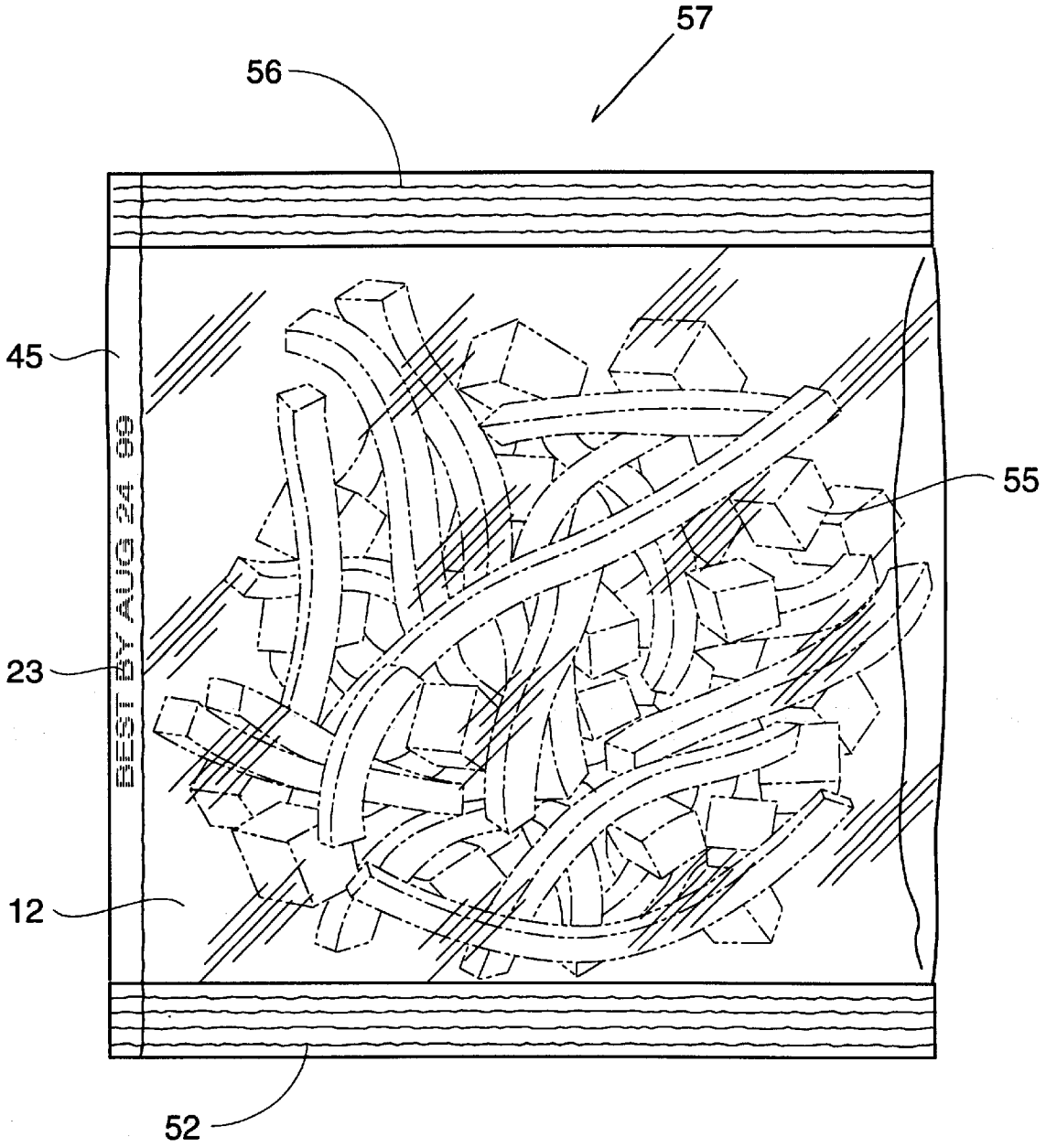
FIG. 5 is a perspective view of a package embodying the invention.

Each succeeding sealed package 57 is deflected by a stationary guide panel 58 onto a suitable endless belt conveyor 60. A sealed pouch-type package 57 with a fin seal 45 containing a blend of shredded and cubed cheese 55 is illustrated in FIG. 5.

It will be readily apparent that the date code 23 embedded within the seal 45 cannot be altered without damaging the material 12 which forms the package 57.

Figure 6:
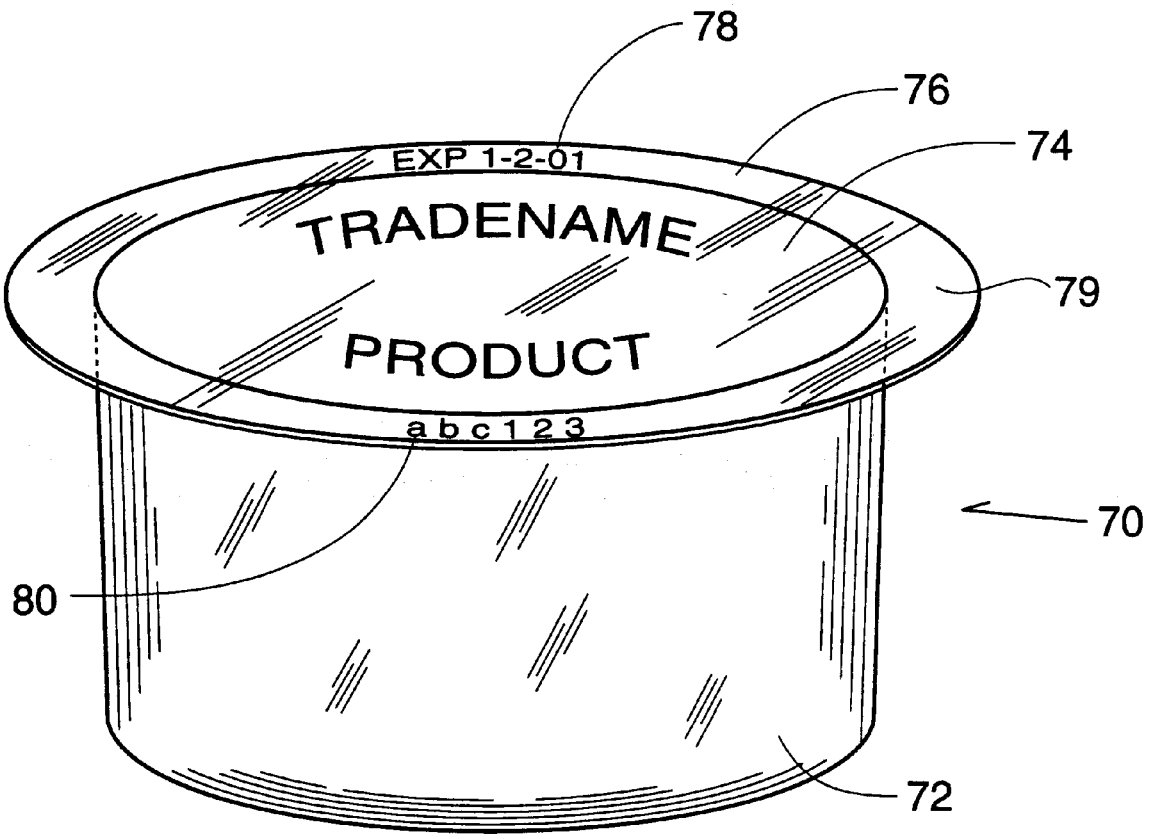
FIG. 6 is a perspective view of another type of container embodying the invention.

FIG. 6 shows another type of container 70 embodying the invention. Container 70 includes a molded plastic cup 72 which forms the body of the container. A lid 74 is secured at its periphery 76 to the rim 79 of the cup 72 by means of thermal molding, adhesives, or the like. At least the periphery 76 of lid 74 is transparent. An inscription 78 is printed on the rim 79 of the cup 72 and is protected by and visible through lid periphery 76. Another inscription 80, also printed on the rim 79 of cup 72 is also protected by and visible through lid 74. In this example, inscription 80 may provide information about the production line and batch number of the specific product sealed within the container 70.

The information may be imprinted on any of the foregoing described packages using visible ink, or, optionally by ink which is viewable only under specific light conditions, such as infrared or ultraviolet. Such imprints may contain information about the source of the goods, for example, identification of a particular packaging plant or specific production line or batch, may be imprinted on each package either alone or in conjunction with a product expiration date for a perishable product such as a food or pharmaceutical product.

It will be apparent to those skilled in the art that various modifications of the foregoing illustrative embodiments are possible. Thus, the invention also encompasses all equivalent embodiments falling within the scope of the following claims.

What is claimed is:

1. A process for packaging a perishable product and providing a tamperproof visible date code on the resultant package comprising;

providing form, fill, and seal package making process equipment;

providing to said equipment a supply of plastic film in strip form having opposed first and second lateral edges and having a thermally sealable side;

printing a date code adjacent to said first edge on said sealable side;

conveying said film through a folding device to cause said printed date code to be overlaid by said second lateral edge of said plastic film, said second lateral edge being transparent;

thermally sealing the lateral edges of said film together with said second edge overlying said imprinted area thereby forming a tube with said, printed date code being visible through said thermally sealed second edge;

forming said tube into a series of individual packages, filling said packages with said perishable product; and sealing said packages, each individual package bearing a protected, visible date code.

2. A process according to claim 1 wherein the film is a laminate having a heat sealable surface and an opposite surface which is more heat resistant than said heat sealable surface.

3. A process according to claim 2 wherein the first and second edges of said heat sealable surface are sealed together in face-to-face contact thereby forming a fin type seal.

4. A process according to claim 1 wherein said process equipment is of the vertical form, fill and seal type.

5. A process according to claim 1 wherein said perishable product comprises cheese.

6. A process according to claim 1 wherein said printer is an ink jet printer which does not physically contact said film, but whereby droplets of ink are deposited on said film forming said date code.

7. A process according to claim 6 wherein a stream of drying gas is directed against said ink droplets after deposition thereof on said film.

8. A process according to claim 6 wherein said ink jet printer is controlled by a microprocessor which permits selection of selected date codes printing.

* * * * *